United States Patent [19]

Ross

[11] Patent Number: 4,592,211

[45] Date of Patent: Jun. 3, 1986

[54] EXPANDABLE FINGER RING

[76] Inventor: Bernard Ross, 190 Franklin Ave., Island Park, N.Y. 11558

[21] Appl. No.: 615,153

[22] Filed: May 30, 1984

[51] Int. Cl.[4] ..... A44C 9/02

[52] U.S. Cl. ..... 63/15.5

[58] Field of Search ..... 63/15.45, 15.5, 15.65, 63/15.7

[56] References Cited

U.S. PATENT DOCUMENTS 3,221,514 12/1965 Newman ..... 63/15.7

FOREIGN PATENT DOCUMENTS 932162 7/1963 United Kingdom ..... 63/15.65

*Primary Examiner*—F. Barry Shay

*Attorney, Agent, or Firm*—Matthew M. Russo; Ernest F. Weinberger

[57] ABSTRACT

An expandable finger ring or the like having a pair of arcuate expandable sections each pivotally hinged at one end by a clevis-like arrangement to an arcuate mounting portion. One expander section is provided with an extending centrally reduced tongue portion which is formed with a longitudinally directed open slot. The slotted portions transverse opening at the tongues open end being greater than that at the opposite end. The other expander section is formed so as to slidingly engage the first expander by being formed with a central longitudinal recess at its free end to receive the tongue portion. Disposed intermediate the walls of the second expander and extending across the recess is a fixed stud of a diameter slightly larger than the narrowest portion of the slot. The stud rides in the slot so that when the expanders are fully slidingly engaged with each other, the stud will tightly abut and frictionally engage the walls of the slot to thereby releasably lock the expander sections together.

1 Claim, 4 Drawing Figures

EXPANDABLE FINGER RING

BACKGROUND OF THE INVENTION

1. Field of the Invention

The present invention relates to ornamental and other articles worn on the fingers or limbs and more particularly pertains to finger rings and the like wherein the ring is expansible for placement on the finger.

2. Description of the Prior Art

In the field of finger rings it has been the general practice to employ separable or adjustable bands to expand the diameter of the ring to permit its placement on or removal from the finger. Such arrangements have been found to be unsatisfactory in that they are mechanically and structurally complex, expensive in both manufacture and assembly, difficult and awkward to use, readily damaged and in some cases may even subject the wearer to possible injury. In those instances where the ring includes a heavy mounting or setting it is difficult to maintain the ring in any desired orientation upon the finger when these prior art arrangements are used to expand the ring since the ring readily slips about the finger and in rare instances it may slip completely off.

SUMMARY OF THE INVENTION

The general purpose of this invention is to provide a ring which will readily pass over the knuckle of the finger thereby permitting easy placement and removal that has all the advantages of similarly employed articles but has none of the above described disadvantages. To attain this, the present invention provides a unique expandable arrangement for two interlocking, pivoted ring sections which are frictionally locked in the closed position. This arrangement permits expansion of the ring prior to placement and contraction thereafter.

An object of the present invention is to provide a ring or the like which may be sufficiently diametrically enlarged to easily pass over a finger joint and then be reduced in size so as to fit properly on the finger.

Another object is to provide a temporarily expandable ring which is simple to use, inexpensive to manufacture, efficient, and attractive in overall appearance.

Other objects and many of the attendant advantages of this invention will be readily appreciated as the same becomes better understood by reference to the following detailed description when considered in connection with the accompanying drawings.

DESCRIPTION OF THE PREFERRED EMBODIMENT

Figure 1:
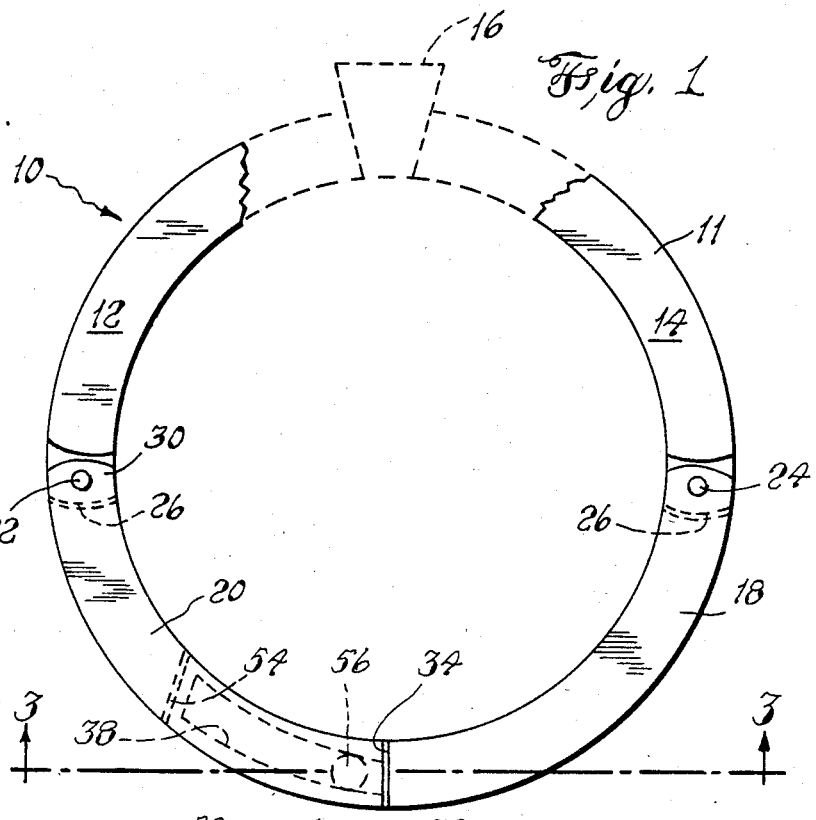
FIG. 1 is a plan view partly in section of a ring made in accordance with the principle of this invention.

In the illustrated embodiment of FIG. 1, the finger ring 10 includes an upper unitary mounting element 11 which, only for illustrative purposes, is divided into two equal upper arcuate portions 12 and 14 that may, if desired, carry intermediate thereof a setting 16. A pair of arcuate expander sections 18 and 20 each of approximately equal length, are pivotally joined to the free ends of portions 12 and 14 via a clevis-like arrangement by pins 22 and 24.

Figure 2:
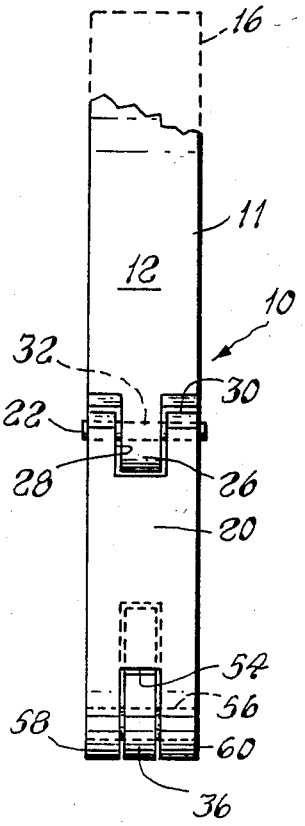
FIG. 2 is a side elevation of the embodiment of FIG. 1.

Referring now to FIG. 2, wherein the end of portion 12 is shown as being formed with a short extension 26 of reduced central thickness, extends into a corresponding recess 28 in the end 30 of section 20. Pin 22 carried by the walls forming the recess 28 passes through an opening 32 in extension 26 to permit pivotal movement between these joined parts. A similar or identical arrangement pivotally joins the opposite section 18 and portion 14 via pin 24.

Figure 3:
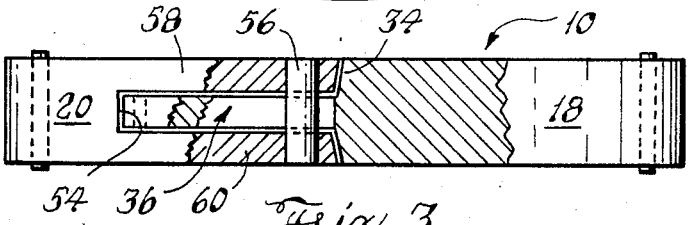
FIG. 3 is a cross-sectional view taken approximately along line 3—3 of FIG. 1.
Figure 4:
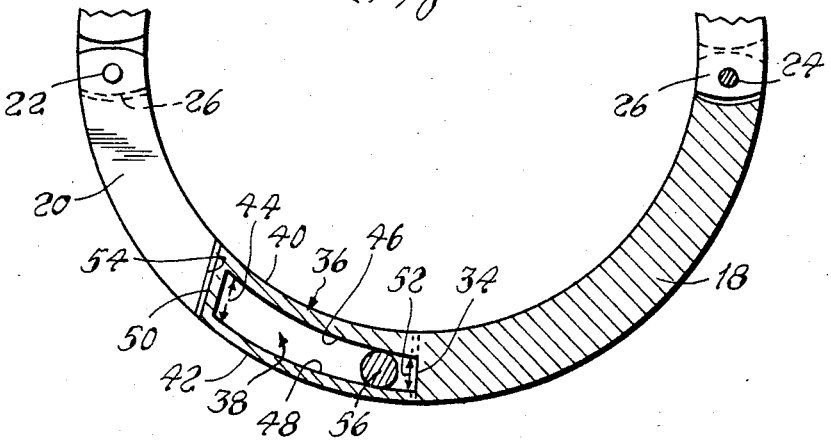
FIG. 4 is another plan view partly in section of the interlocking sections of the illustrated embodiment.

As shown in FIGS. 3 and 4, expander section 18 is circumferentially less than one-quarter of the length of the ring 10 to the face 34 where it abuts expander 20. In addition expander 18 includes an arcuate slotted extension 36 of reduced central thickness. The arcuate slot 38 defined by the walls 40 and 42 of extension 36 is formed so that the opening 44 between the inner slot surfaces 46 and 48 proximate its free end 50 is larger than the corresponding opening 52 near the face 34. Therefore, the transverse slot opening effectively converges in a direction from the free end 50 toward the face 34. Although the slot opening is illustrated as gradually converging it could equally well be constant throughout except for a small segment proximate face 34 where it could be abruptly narrowed or stepped.

Expander section 20 is formed for sliding, interlocking and mating relationship with section 18 for expansion and contraction of the ring. For this purpose, section 20 is formed with a central arcuate longitudinal recess 54 at its free end. The dimensions of recess 54 are such that slotted extension 36 will slidingly mate therewith. In addition, for guiding, retaining and frictionally locking extension 18 into extension 20 there is provided a locking guide stud 56. Stud 56 extends between the walls 58 and 60 which define the recess 54 and slidingly passes through the slot 38 in extension 36. The transverse dimension or diameter of stud 56 if circular in cross-section, is such that when the sections 18 and 20 are moved relative to one another from a fully expanded ring to the contracted position, the stud rides freely in the slot 38 until it is proximate end opening 52. From this point on the stud 56 tightly abuts slot faces 46 and 48 or can even slightly bow the side walls 40 and 42 of extension 18 when the two expander sections are joined.

In use, the wearer initially separates the expander sections by merely pulling them apart to thereby pivot the sections about their respective pins 22 and 24. With the ring circumference thus enlarged the wearer can easily emplace the ring on his finger even over a swollen joint or knuckle without force or any chance of injury. Once the ring is positioned on the finger the wearer merely pushes the expander sections together. Removal of the ring simply requires the reversal of the above steps. It is of course understood that the ring is fabricated to comfortably fit the wearer's finger.

Obviously many modifications and variations of the present invention are possible in the light of the above teachings. It is therefore to be understood that, within the scope of the appended claims, the invention may be practiced otherwise than specifically described.

I claim:

1. An expandable finger ring or the like comprising:

an upper segment portion, means pivotally connecting said segment portion at its free ends to, first and second expander sections, said second expander section including a longitudinal extension extending toward said first expander section in which a rigidly closed slot continuously converging in a direction from the free end of said extension toward the pivotal connection of said second expander section, is formed, said first expander section carrying a stud and provided with a longitudinal recess across which said stud is disposed and in which said extension is slidingly received, the transverse dimension of said stud being slightly greater than the narrowest slot dimension, and wherein said stud will tightly abut the walls defining said slot when said ring is contacted and thereby releasably hold said expander sections together, whereby said ring circumference is expandable and contractable for placement on a wearer's finger or limb.

* * * * *